US005449336A

United States Patent [19]

Sabel

[11] Patent Number: 5,449,336

[45] Date of Patent: Sep. 12, 1995

[54] STRETCHING MACHINE

[76] Inventor: Amy L. Sabel, P.O. Box 1130, Larkspur, Calif. 94977

[21] Appl. No.: 139,569

[22] Filed: Oct. 18, 1993

[51] Int. Cl.[6] ..... A63B 21/00

[52] U.S. Cl. ..... 482/133; 482/130; 482/134; 482/907; 601/24; 601/33; 602/34

[58] Field of Search ..... 606/241; 602/32-36; 601/24, 26, 33; 482/91, 130, 131, 133, 134, 139, 907, 23, 24, 35-38, 43, 69, 143

[56] References Cited

U.S. PATENT DOCUMENTS

| | | | |
|---|---|---|---|
| 2,267,376 | 12/1941 | Malm | 482/130 |
| 3,501,140 | 3/1970 | Eichorn | 482/130 |
| 3,664,666 | 5/1972 | Lloyd | 482/133 |
| 4,489,713 | 12/1984 | Latenser | 602/34 |

FOREIGN PATENT DOCUMENTS

| | | | |
|---|---|---|---|
| 40866 | 10/1973 | Australia | 482/133 |
| 1193897 | 11/1959 | France | 482/139 |
| 2414327 | 8/1979 | France | 602/32 |
| 2638077 | 3/1977 | Germany | 602/32 |

*Primary Examiner*—Richard J. Apley
*Assistant Examiner*—Jeanne M. Clark
*Attorney, Agent, or Firm*—Larry D. Johnson

[57] ABSTRACT

A stretching machine provides a structural framework upon which a user can perform a series of assisted stretching exercises. The framework includes a number of restraint points where the user can be positioned and stabilized, and a motor-driven tractive line that slowly and safely applies a stretching motion to the user.

13 Claims, 6 Drawing Sheets

STRETCHING MACHINE

BACKGROUND OF THE INVENTION

1. Field of the Invention

This invention relates generally to exercise equipment and sports apparatus, and more specifically to an improved stretching machine for the human body.

2. Description of the Prior Art

It is now widely recognized that proper stretching of the muscles is an important aspect to overall fitness and health. However, most known stretching regimens simply provide independent (non-assisted) exercises or movements that the individual must perform. Some forms of structural apparatus have been designed to provide a stationary surface or bar against which a user may stretch, but these structures are for similarly non-assisted movements.

SUMMARY OF THE INVENTION

The stretching machine of this invention provides a structural framework upon which a user can perform a series of assisted stretching exercises. The framework includes a number of restraint points where the user can be positioned and stabilized, and a motor-driven tractive line that slowly and safely applies a stretching motion to the user. The key features of the system include:

Framework: The inventive stretching machine may have a fixed or adjustable framework that can be selectively positioned from both sides, telescoping in and out or up and down. In addition, any bar of the framework can preferably be removed or placed on one side or other (or in the middle) for different stretch exercises or for different user's height, body size and flexibility. The dimensions of the framework are variable and can be adjusted. The base platform can also be adjusted so that the angle and position of inclination will vary according to a user's body shape, size, flexibility and stretch position.

Alternatively, the overhead bar can be replaced with a fixed pulley attached to a ceiling or other overhead support. The whole framework can preferably be telescoped or folded in to enable efficient storage. In certain installations, the base platform can be flush with the ground, which would make it wheelchair accessible and enable certain floor stretches to be done. The stretching machine base platform may include cushioned back supports for lying and sitting exercises as well as foot and leg boards to help keep the body in correct positions and for extra support.

Restraints: The user can be held in a desired position by a seat belt or similar restraining device so that the body is held in place for the proper stretch/exercise technique and to prevent injury. The seatbelts are preferably padded for comfort, and can be made in various widths and can be positioned at various places along the base platform. They can also be positioned or attached to the vertical or horizontal bars of the framework to hold or restrain the body in a standing or other vertical position. Markings on the platform may also be included to assist in aligning the body properly to provide optimal positioning of the body for balance and technique in stretching and exercising.

Shoulder straps, hipstraps, ankle straps, wrist straps and head straps may be attached to the tractive line and utilized for various stretching exercises, and can be adjustable in size and have a quick release function (e.g., Velcro, mechanical quick-release).

Tractive Line: The system includes an anchored (stationary) motor or other motive source connected to at least one tractive line which is conveyed either directly or indirectly (e.g., by pulley) to the user's body. The tractive line is preferably either elastic or semi-elastic. The motor creates pull or force through the tractive line to stretch the user's muscles in an even, gradual way. The force of the motor can be regulated to suit the relative structural strength and resistance of the specific user.

The pulley with its attachment may be adjusted up and down on the links of a chain suspended by the framework in order to have the right height for the stretch exercise. The motor can be controlled to create greater force or pull to maintain stretch, or release stretch instantaneously upon any discomfort by the user and then resume increasing stretch (pull) according to the user's wishes. The remote control (wired or wireless) can be either hand-held or mounted on the platform or framework so that it can be actuated by the feet or other parts of the body, or by another person.

The amount of stretching can be monitored by means of a mechanical or electronic measuring system, which may include digital or other displays to indicate the amount of torque applied in a stretch. In addition, the system could have a micro-chip memory system which will store the amount of torque needed for particular stretches. The electronic measuring and recording system may also include a print-out function.

This monitoring and measuring system can also be programmable so that as a safety function the machine will only pull to a certain level of speed and torque for each respective stretch and for varying levels of weight and body size. The purpose of this is to avoid too quick of a stretch or too much torque to the user which could cause pain or injury. In physical therapy applications, the speed and levels of stretch can be either manually controlled or programmed according to the condition, size, weight and body type of the user.

The system may further include a feedback mechanism whereby when a pre-determined dangerous level of stretching or torque is reached, the system will not allow the user to take the stretch any further. As with most exercise, the most valuable regulating mechanism is the body's ability to experience pain as a warning signal. However, some individuals believe pain should be an element of exercise and this refinement could guard against this.

Also, as a means of regulating repetitive exercises (for example, lifting and lowering the leg) for strengthening or stretching, the machine could be set or programmed to pull at a certain speed and torque and release at a certain speed and torque. This would enable handicapped people to get movement in their bodies. It would also help people having certain injuries and weakened body parts.

Applications for the inventive stretch machine include installations in gyms, health clubs, physical therapist offices, orthopedic offices, sports medicine centers, home, professional sports teams, hospitals, schools, senior citizen homes, massage and bodywork centers, chiropractors offices, recreation centers, handicap centers, dance centers, and yoga centers.

The apparatus can be used to stretch every major muscle group of the body. The installed apparatus may include explanatory materials such as charts, names and diagrams for specific stretch positions, either attached to the apparatus or in a written manual and/or videotape demo.

Figure 1:
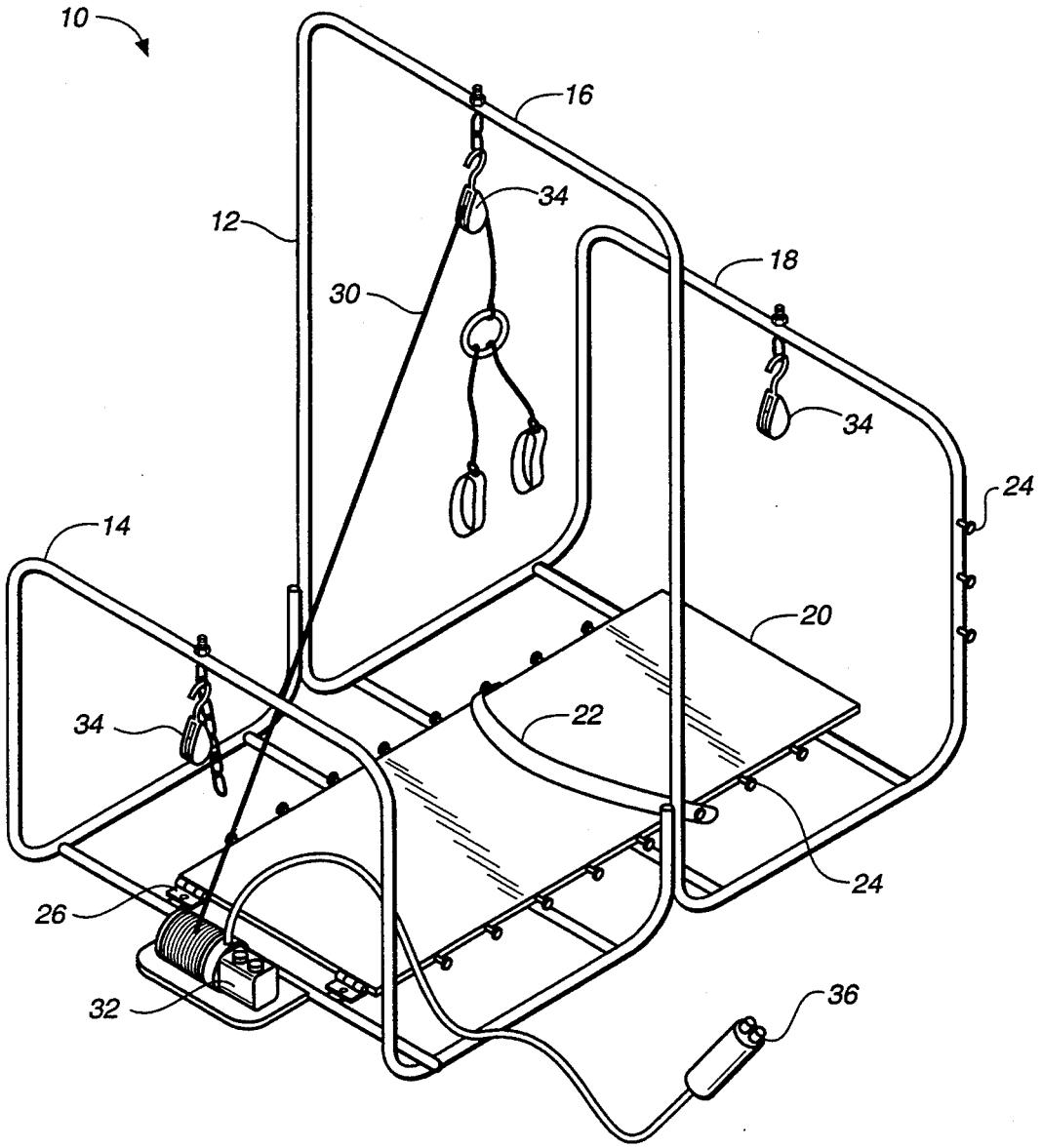
FIG. 1 is a perspective view of a stretching machine of this invention, illustrating its component parts including.
Figure 2:
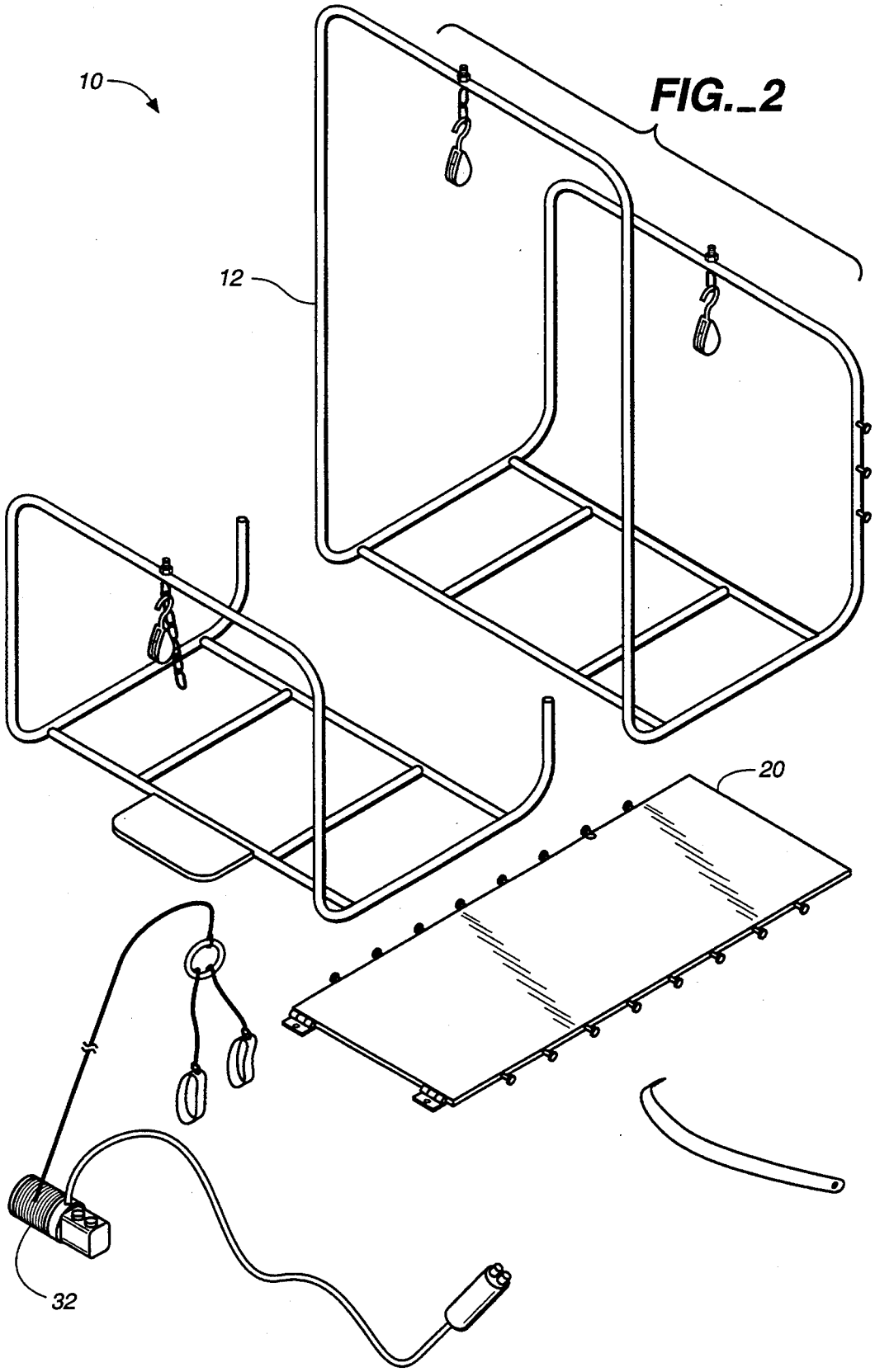
Figure 3:
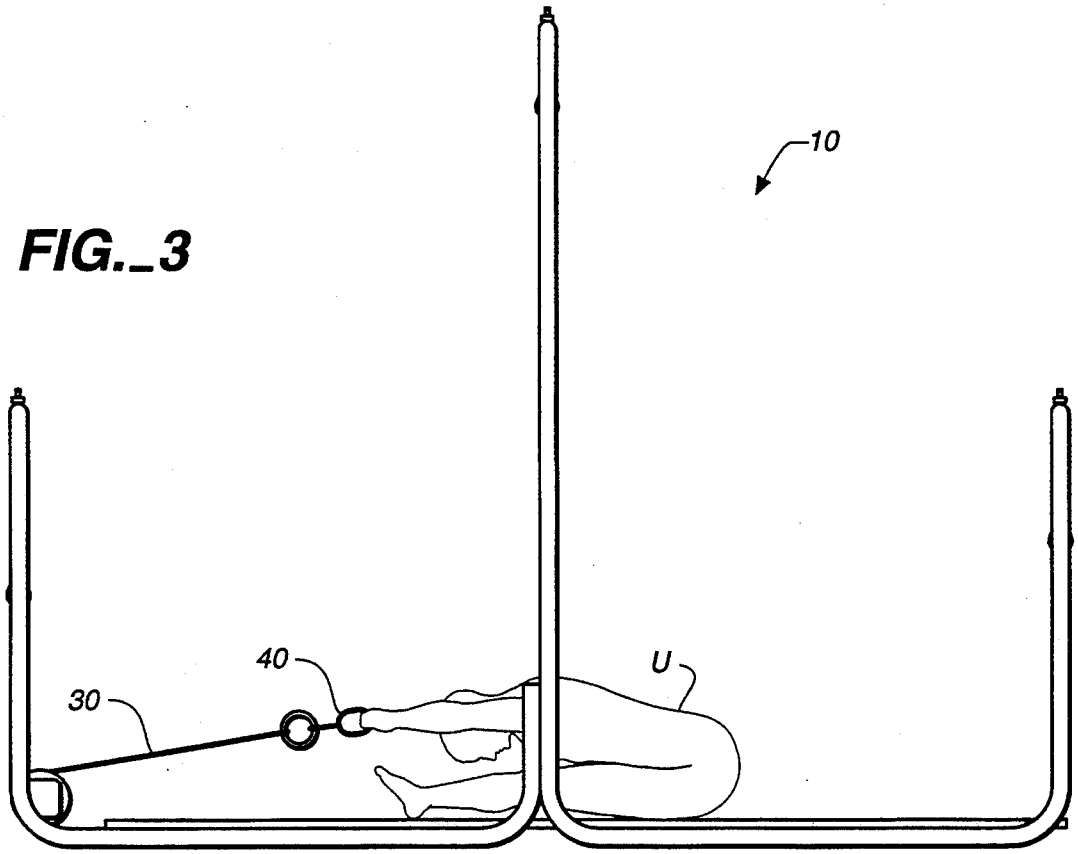
Figure 4:
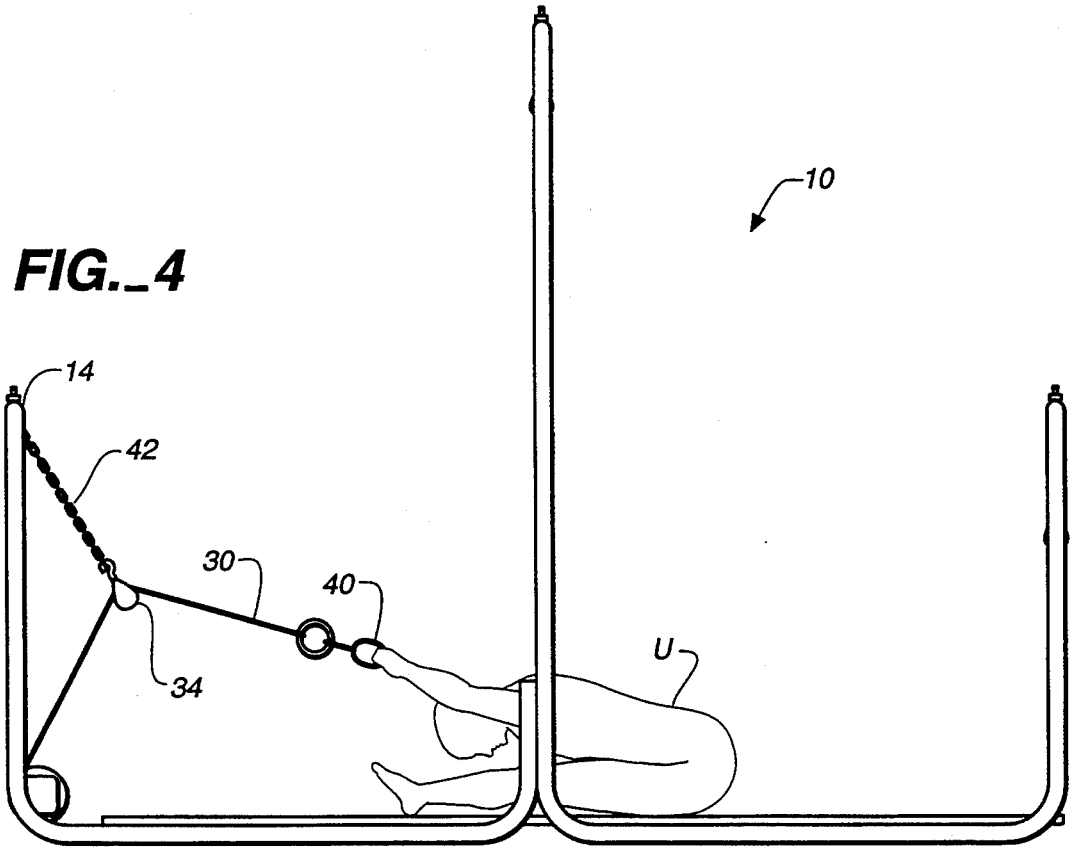
Figure 5:
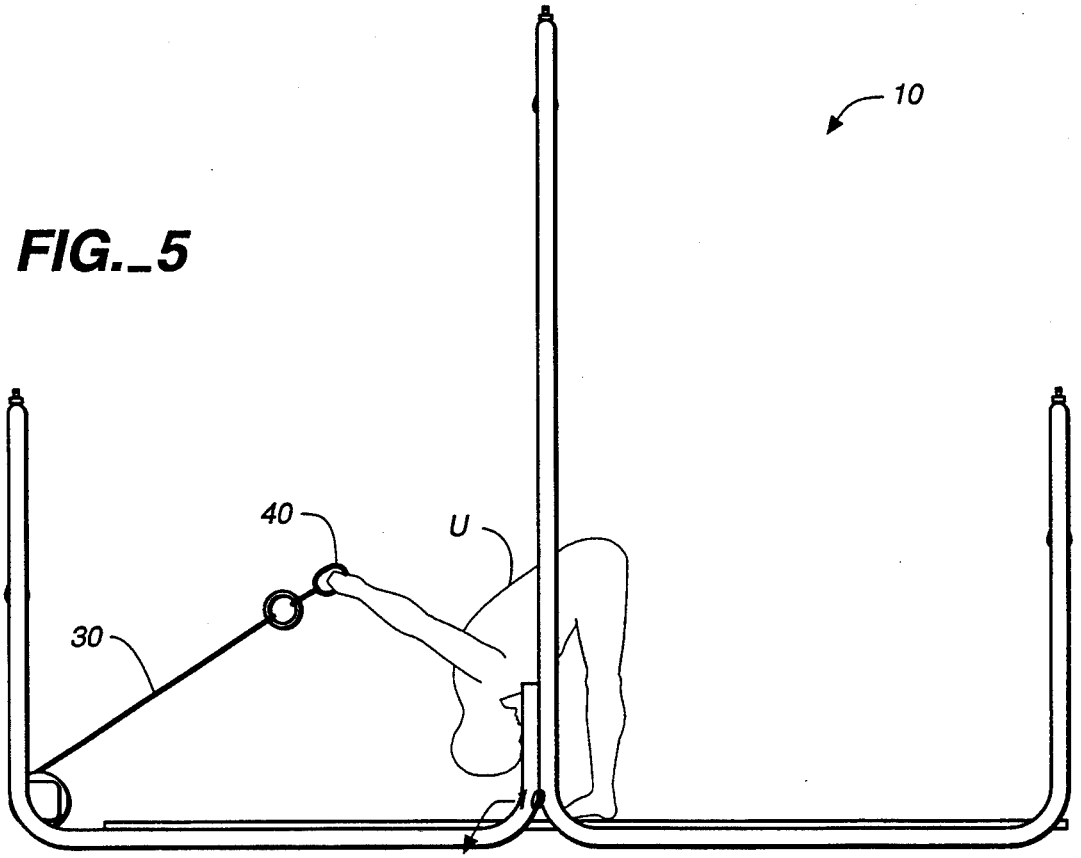
Figure 6:
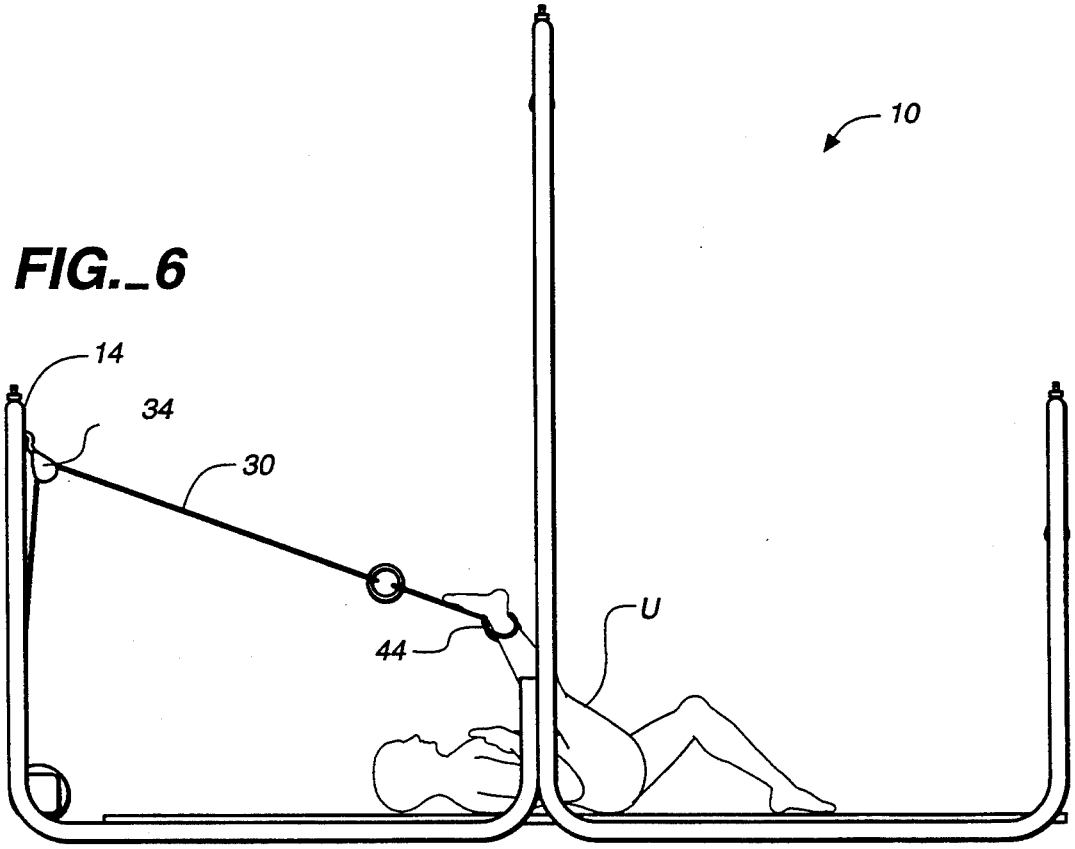
Figure 7:
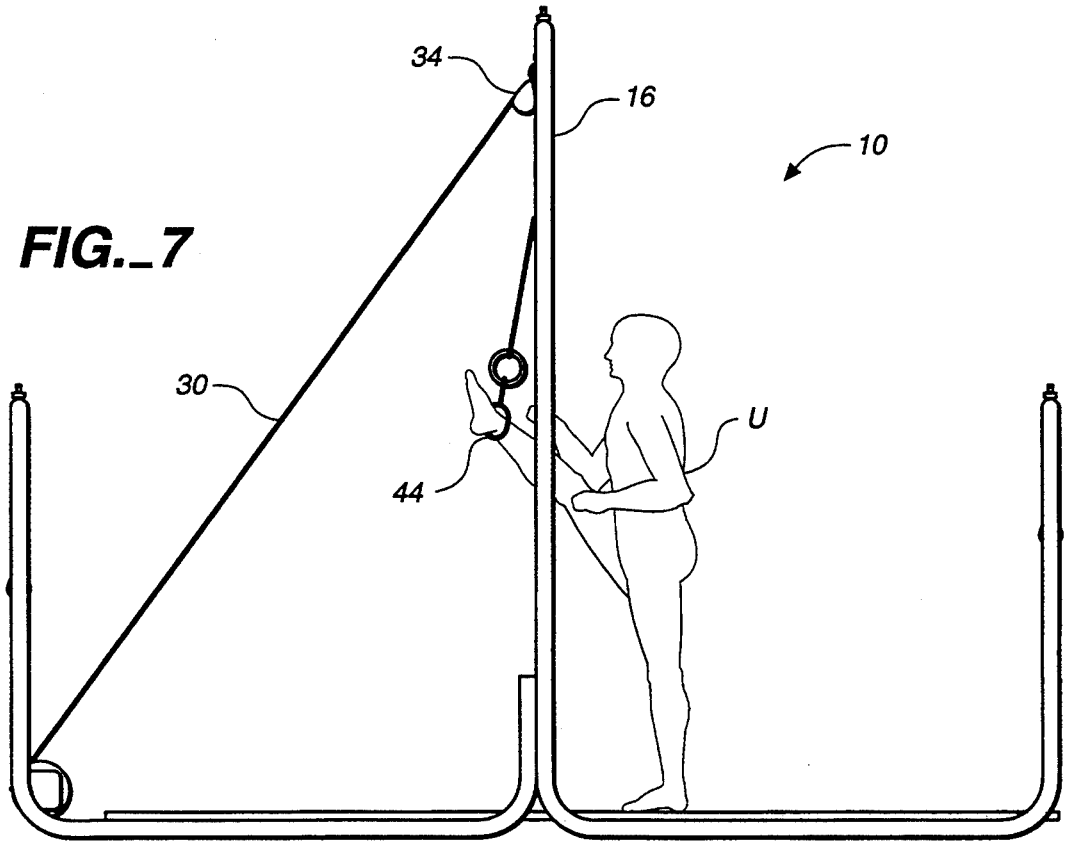
Figure 8:
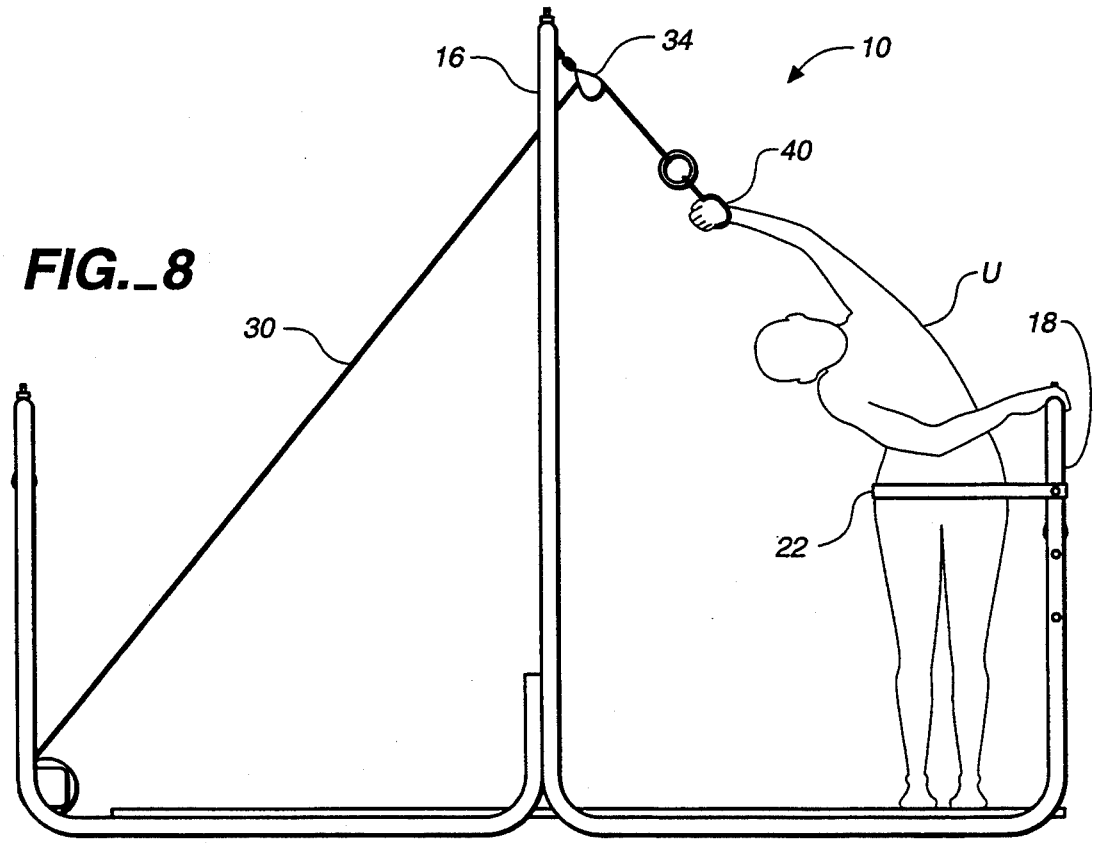
Figure 9:
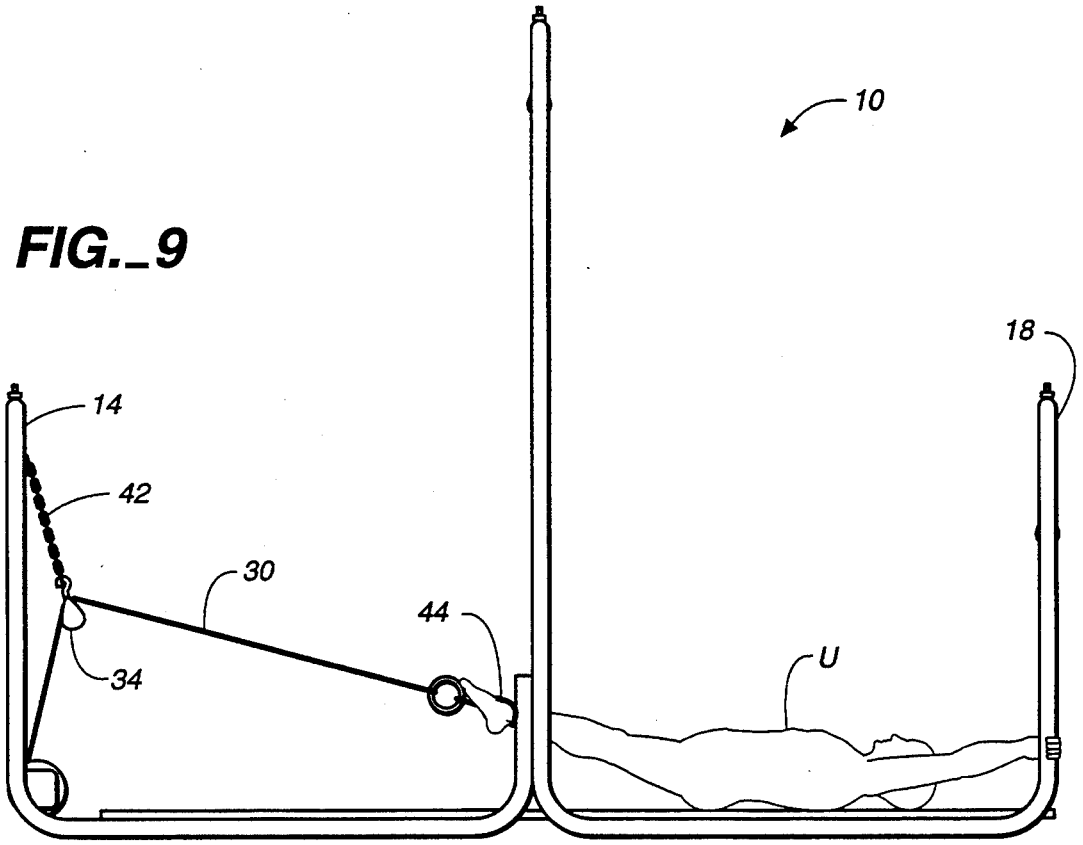
Figure 10:
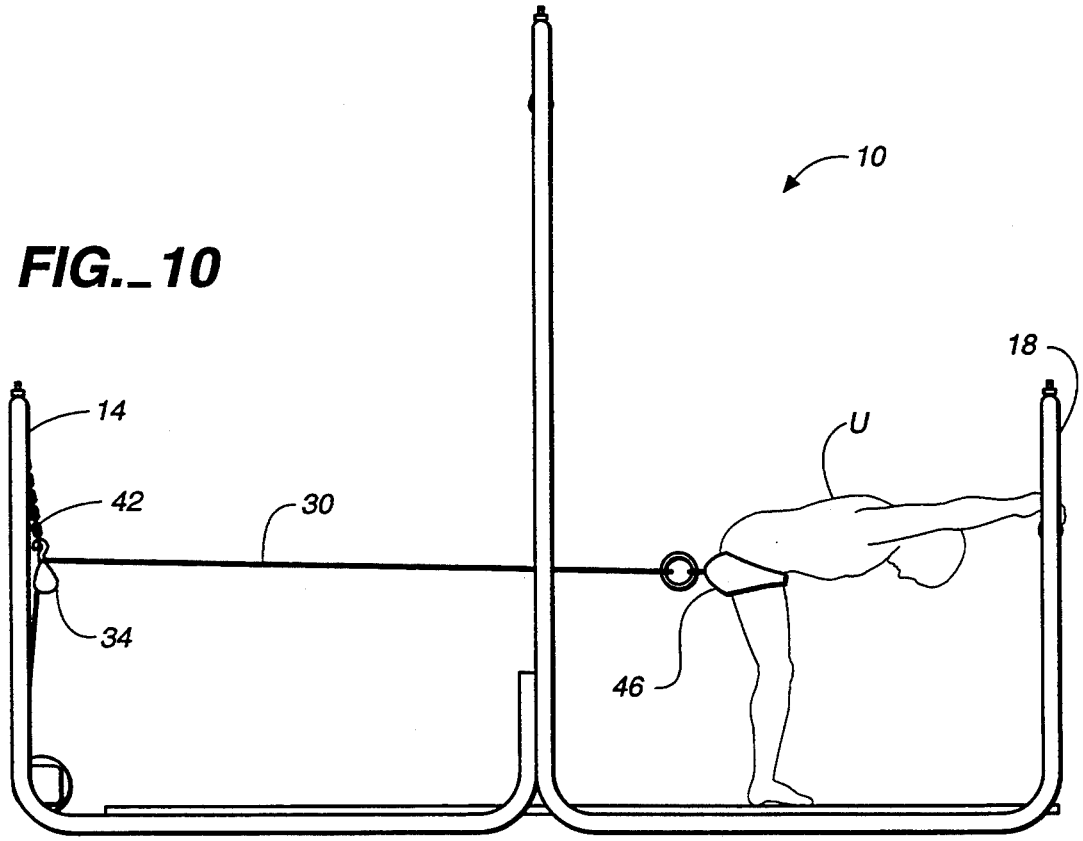

- a framework including a first end bar, overhead bar, and second end bar, and a base platform extending between the end bars and beneath the overhead bar;
- a restraint in the form of a seatbelt and a plurality of belt fastening points on the base platform and framework; and
- a tractive line driven by a motor and clutch assembly, and extending to the user either directly or through one or more pulleys, the motor and clutch having a remote control accessible to the user while exercising;

FIG. 2 is an exploded perspective view of the stretching machine of FIG. 1;

FIG. 3 is a side elevation view of the stretching machine of this invention in use, with the tractive line extending directly to the user, and the user releasably capturing the tractive line by hand grips;

FIG. 4 is a side elevation view of the stretching machine of this invention in use, with the tractive line extending to the user through a pulley supported on a chain a distance below the first end bar, and the user releasably capturing the tractive line by hand grips;

FIG. 5 is a side elevation view of the stretching machine of this invention in use, with the tractive line extending directly to the user, and the user releasably capturing the tractive line by hand grips;

FIG. 6 is a side elevation view of the stretching machine of this invention in use, with the tractive line extending to the user through a pulley supported on and adjacent to the first end bar, and the user releasably capturing the tractive line by an ankle strap;

FIG. 7 is a side elevation view of the stretching machine of this invention in use, with the tractive line extending to the user through a pulley supported on and adjacent to the overhead bar, and the user releasably capturing the tractive line by an strap grip;

FIG. 8 is a side elevation view of the stretching machine of this invention in use, with the tractive line extending to the user through a pulley supported on and adjacent to the overhead bar, and the user releasably capturing the tractive line by a hand grip, and restrained by a seat belt fastened to the second end bar;

FIG. 9 is a side elevation view of the stretching machine of this invention in use, with the tractive line extending to the user through a pulley supported on a chain a distance below the first end bar, and the user releasably capturing the tractive line by ankle straps, and manually grasping the second end bar for restraint; and FIG. 10 is a side elevation view of the stretching machine of this invention in use, with the tractive line extending to the user through a pulley supported on a chain a distance below the first end bar, and the user releasably capturing the tractive line by a hip strap, and manually grasping the second end bar for restraint.

DETAILED DESCRIPTION OF A PREFERRED EMBODIMENT

FIG. 1 is a perspective view of a stretching machine 10 of this invention, illustrating its component parts including a framework 12 including a first end bar 14, an overhead bar 16, and a second end bar 18, and a base platform 20 extending between the end bars and beneath the overhead bar. This framework may be made of tubing, rectangular stock, or any other appropriate material, and may be in any size or configuration.

Also included is some form of restraint such as a seatbelt 22 and a plurality of belt fastening points 24 on the base platform 20 and framework 12. The base platform preferably includes a non-slip top surface, and may be pivotable at hinge 26 to enable inclined stretching positions.

A tractive line 30 is driven by a motor and clutch assembly 32, and extends to the user either directly or through one or more pulleys 34. The motor and clutch may have a remote control 36 accessible to the user while exercising. The motor itself may be a small, properly geared DC electric motor (e.g., one-thirtieth horsepower, fifty inch-pound torque, 314:1 gear ratio, eleven rpm), with an electromagnetic clutch, and controls for torque and speed. Remote control 36 may include two controls: one for forward (stretching the user) and one for back or release.

FIG. 2 is an exploded perspective view of the stretching machine 10 of FIG. 1. This view illustrates one way, but certainly not the only way, that the framework/-platform, restraint, and tractive line portions may be arranged. For example, the framework 12 may be capable of complete assembly and disassembly. The base platform 20 may be hinged at the middle for angulation, or may include removable pads or other features. The motor and clutch 32 may be positioned more distant from the framework, or be housed beneath a raised platform.

FIG. 3 is a side elevation view of the stretching machine 10 of this invention in use, with the tractive line 30 extending directly to the user U, and the user releasably capturing the tractive line by hand grips 40. In this and subsequent views, the user may or may not be secured to the framework and/or base platform by a physical restraint.

FIG. 4 is a side elevation view of the stretching machine 10 of this invention in use, with the tractive line 30 extending to the user U through a pulley 34 supported on a chain 42 a distance below the first end bar 14, and the user releasably capturing the tractive line by hand grips 40. This view illustrates how a simple adjustment of pulley 34 affects the angle of the tractive line to the user (compare to FIG. 3). Pulley 34 may also be secured at its base to the framework, thereby limiting "play" in the tractive line.

FIG. 5 is a side elevation view of the stretching machine 10 of this invention in use, with the tractive line 30 extending directly to the user U, and the user releasably capturing the tractive line by hand grips 40. This view illustrates the same tractive line arrangement as in FIG. 3, supra, but for a completely different stretching exercise.

FIG. 6 is a side elevation view of the stretching machine 10 of this invention in use, with the tractive line 30 extending to the user U through a pulley 34 supported on and adjacent to the first end bar 14, and the user releasably capturing the tractive line by an ankle strap 44. In this view, the pulling angle for the tractive line is higher than that depicted in FIG. 4, supra, by virtue of the positioning of the pulley adjacent the bar, instead of distanced from it.

FIG. 7 is a side elevation view of the stretching machine 10 of this invention in use, with the tractive line 30 extending to the user U through a pulley 34 supported on and adjacent to the overhead bar 16, and the user releasably capturing the tractive line by an ankle strap 44. Use of a pulley on the overhead bar enables such upright stretching positions.

FIG. 8 is a side elevation view of the stretching machine 10 of this invention in use, with the tractive line 30 extending to the user U through a pulley 34 supported on and adjacent to the overhead bar 16, and the user releasably capturing the tractive line by a hand grip 40, and restrained by a seat belt 22 fastened to the second end bar 18. Use of the seatbelt 22 or other restraint is desirable in this and many other stretching exercises, as opposed to reliance on manual grasping of the end bar (as also illustrated).

FIG. 9 is a side elevation view of the stretching machine 10 of this invention in use, with the tractive line 30 extending to the user U through a pulley supported on a chain 42 a distance below the first end bar 14, and the user releasably capturing the tractive line by ankle straps 44, and manually grasping the second end bar 18 for restraint. In this exercise, no supplemental restraint is necessary.

FIG. 10 is a side elevation view of the stretching machine 10 of this invention in use, with the tractive line 30 extending to the user U through a pulley 34 supported on a chain 42 a distance below the first end bar 14, and the user releasably capturing the tractive line by a hip strap 46, and manually grasping the second end bar 18 for restraint. Various other straps, such as shoulder straps, head straps, or the like, may also be employed for particular stretching exercises.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A stretching apparatus to provide assisted stretching to a user, said stretching apparatus comprising:

a framework including a pair of end members, each end member comprised of first vertical supports connected to a horizontal end bar member and configured such that said horizontal end bar members are adapted to be positioned above the user when the user is lying down, a horizontal overhead bar member centrally located between and parallel to said horizontal end bar member and second vertical supports connected to the overhead bar member for supporting the overhead bar member above said horizontal end bar members;

a base platform extending between said horizontal end bar members and beneath said horizontal overhead bar member;

a motor driven winding means connected to said framework adjacent the base platform for selectively extending or retracting a tractive line for releasable capture by the user;

said tractive line having a first end operationally connected to said motor driven winding means and a second end operationally connected to a user attaching means for connecting the user to the tractive line;

attachment means located on the horizontal overhead bar member and the horizontal end bar members for selectively connecting the tractive line; and pulley means adapted for connection to one of said attachment means on said framework for conveyance of said tractive line to the user from alternate positions, wherein when the user is connected to the user attaching means and said motor driven winding means retracts said tractive line, the user's body is stretched in the direction of said tractive line retraction and wherein the tractive line can be anchored to the framework by the attachment means at multiple locations and heights to achieve multiple stretching exercises in different directions for the user.

2. The stretching apparatus of claim 1 wherein said framework base platform is hinged to enable pivotal movement relative to said framework.

3. The stretching apparatus of claim 1 further including restraint means for securing the user to said framework.

4. The stretching apparatus of claim 3 wherein said restraint means comprises a seat belt and a plurality of belt fastening points on said framework.

5. The stretching apparatus of claim 1 further including restraint means comprising a seat belt and a plurality of belt fastening points on said base platform.

6. The stretching apparatus of claim 1 wherein said tractive line comprises an elastic line.

7. The stretching apparatus of claim 1 wherein said user attaching means includes a hand grip.

8. The stretching apparatus of claim 1 wherein said user attaching means includes an ankle strap.

9. The stretching apparatus of claim 1 wherein said pulley means is connected to said framework by a chain having length adjustment means.

10. The stretching apparatus of claim 1 wherein said motor driven winding means comprises a motor and clutch assembly.

11. The stretching apparatus of claim 10 wherein said motor and clutch assembly includes controls for motor torque and speed.

12. The stretching apparatus of claim 10 wherein said motor and clutch assembly includes a remote control accessible to the user while exercising.

13. The stretching apparatus of claim 12 wherein said remote control includes means for controlling the direction of said tractive line motion.

* * * * *